United States Patent [19]

Danley et al.

[11] Patent Number: 4,531,025

[45] Date of Patent: Jul. 23, 1985

[54] LOUDSPEAKER WITH COMMUTATED COIL DRIVE

[75] Inventors: Thomas J. Danley, Highland Park; Charles A. Rey, Naperville, both of Ill.

[73] Assignee: Intersonics Incorporated, Northbrook, Ill.

[21] Appl. No.: 590,897

[22] Filed: Mar. 19, 1984

[51] Int. Cl.[3] ..... H04R 9/04

[52] U.S. Cl. ..... 179/115.5 VC

[58] Field of Search ..... 179/115.5 VC, 115.5 R, 179/178

[56] References Cited

U.S. PATENT DOCUMENTS 4,160,133 7/1979 Wiik ..... 179/115.5 VC 4,327,257 4/1982 Schwartz ..... 179/115.5 R

*Primary Examiner*—Gene Z. Rubinson

*Assistant Examiner*—Danita R. Byrd

*Attorney, Agent, or Firm*—Gary, Juettner & Pyle

[57] ABSTRACT

An improvement is provided in a loudspeaker having a current carrying coil disposed in the flux gap of a permanent magnet and carrying current to drive the coil and an associated sound diaphragm. The coil is substantially longer than the thickness of the flux gap and has an exposed conductive surface. Contacts are mounted near each side of the flux gap and slidably engage the coil surface to supply current to a limited portion of the coil situated in the flux gap, irrespective of movement of the coil.

7 Claims, 1 Drawing Figure

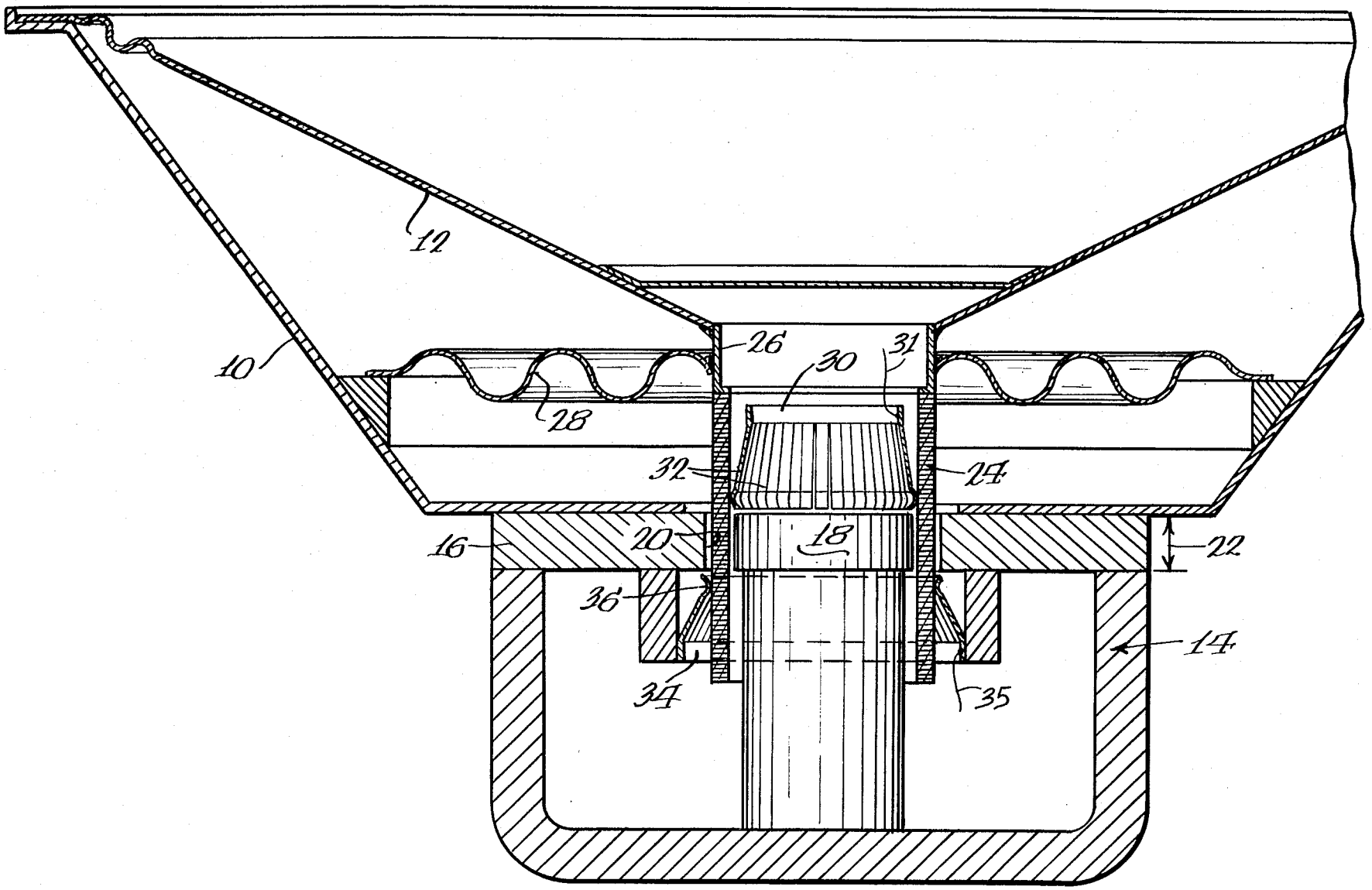
22
14
24
35
31
30
18
26
32
20
34
36
28
16
12
10

LOUDSPEAKER WITH COMMUTATED COIL DRIVE

BACKGROUND OF THE INVENTION

This invention relates to improvements in so-called dynamic loudspeakers wherein a coil is provided with electrical current and is disposed in a magnetic field to produce an axial driving force on the coil and on a sound radiator attached to the coil.

Most conventional loudspeakers in use today comprise a cylindrical voice coil that is disposed in a radial magnetic field created by the pole pieces of a magnet. The pole pieces are arranged to provide a circular gap, and the coil, having one or more layers of turns of wire, is disposed in the gap. The ends of the coil are connected to a source of signal current, such as an amplifier. The current passing through the length of the coil creates a field that links with the magnetic field of the magnet to produce a driving force on the coil. The force (F) on the coil is equal to BLI, where B is the flux density, L is the length of wire immersed in the magnetic flux, and I is the current.

In many types of speaker drives, the length of the cylindrical coil is fabricated to be approximately equal to the fixed thickness or depth of the magnetic poles at the gap. In this manner, substantially the entire useful length of the coil is immersed in the magnetic field, enhancing total efficiency.

The production of low frequency sound presents special problems for a woofer having a moving coil drive. In order to produce low frequency sound of sufficient intensity, it is desirable for the available peak to peak excursion of the voice coil be as large as possible, in order for the sound diaphragm to excite large volumes of air. Such large excursions, however, cause the voice coil to move either partially or entirely out of the region of constant magnetic flux, producing distortions, since the force per unit current decreases as the active length of the voice coil is reduced. The term "active length" is defined herein as only that part of the coil which remains in the magnetic field in the gap.

In order to overcome the low frequency distortion problem and increase available excursion, longer or overhanging voice coils have been employed, in which the length of the coil is greater than the thickness of the magnetic gap. The use of a longer coil, however, results in a substantial loss of efficiency, since only the active portion of the coil in the magnetic field contributes to the driving force. The use of a longer coil also creates greater total resistance to the flow of current and places a limit on power handling capacity due to the production of heat, which is proportional to the resistance.

From the foregoing, it may be seen that if large peak to peak excursions are required in a movable coil drive for a speaker, problems are encountered that result in loss of linearity, loss of efficiency, or both, particularly in lowermost frequencies of human hearing, i.e., below 75 Hz. Thus, it would be desirable to devise a moving-coil drive having features that would overcome or avoid these problems.

SUMMARY OF THE INVENTION

In accordance with the present invention, a moving-coil speaker drive is provided with a cylindrical coil disposed and supported for axial movement in an annular magnetic field having a given thickness, in order to produce linear axial forces on the coil. The length of the coil is substantially greater than the thickness of the magnetic field at the gap. Unlike prior art versions, however, current is not passed through the entire length of the coil to effect the driving force. Instead, current is passed through only the limited portion of the coil that is immersed in the magnetic field. This is accomplished by a stationary electrical contact on both sides of the magnetic pole that is in sliding electrical contact with the coil, with the contacts being connected to the source of signal current. This communication results in a situation where only a fraction of the length of the coil is active, and such active fraction is always disposed in the region of magnetic flux irrespective of the movement or axial position of the coil.

Since only a portion of the coil carries current at any given time, the remaining portions can absorb and dissipate heat generated by the active portion, thereby greatly increasing power handling capacity and improving electrical efficiency. Moreover, since the coil is commutated, the drive force on the coil is constant per unit current, whereby the drive force is linear over the entire length of available excursion, thereby greatly reducing distortion.

THE DRAWING

The FIGURE is a section view, along the axis of the drive, of a moving-coil loudspeaker that incorporates features of the presently described invention.

DESCRIPTION OF THE PREFERRED EMBODIMENT

The improvement of the present invention will be described in conjunction with a speaker having an arrangement of parts similar to those used in a conventional moving-coil loudspeaker. A rigid cone-shaped support, called a basket 10, is used to support the various components of the speaker, including the outer perimeter of a cone-shaped sound diaphragm 12, and a permanent magnet assembly, generally indicated at 14. The magnet assembly comprises an annular outer pole 16 and a central inner pole 18 of opposite polarity, with the inner and outer poles being spaced to define an annular gap 20. The distance between the inner and outer poles is referred to as the gap width, and the other dimension, indicated at 22, is referred as the gap thickness or depth. The permanent magnet assembly creates a zone of constant magnetic flux in the annular gap 20 which extends substantially entirely between the opposite pole faces that define the gap.

An elongate coil 24 is resiliently suspended in the gap 20 such that the sides of the coil are spaced from the opposed pole faces. The length of the coil 22 is substantially longer than the thickness 22 of the gap 20, and, in fact, may be of any desired length, depending on the amount of excursion required. The coil is made up from a continuous or unterminated layer of windings of conductive wire, and the wire, such as copper, may have a rectangular cross section to increase efficiency. Adjacent or contiguous wire strands are insulated from one another, such as by using coated wire. Either one or both of the inner and outer cylindrical surfaces of the coil, however, are bare and electrically conductive along successive individual exposed wires in the coil. The exterior surfaces of the coil are preferably smooth and uninterrupted.

One end of the coil 24 projects outwardly from the magnetic gap 20 and is secured directly or via a cylindrical extension 26 to the apex of the cone diaphragm 12, similar to prior art constructions. An annular flexible web or spider 28 extends between the support basket 10 and the coil extension 26 to support the coil and to confine the movement thereof in an axial linear direction.

In prior art loudspeaker systems, the coil would be formed of a single length of wire in which the ends of the wire would be connected by flexible wires to terminals on the basket and thence to the leads from the source of signal current. In this fashion, current would pass through the entire length of the coil, although only a portion of the coil would be disposed within the magnetic gap. As a result, the entire length of the coil would generate resistance losses and would impose a power handling limit, which if exceeded, would cause thermal destruction of the coil. Since only that portion of the coil within the magnetic gap is active, a substantial loss in electrical efficiency would be experienced.

In accordance with the present invention, means are provided to limit the current carrying portion of the coil substantially to the region of the coil located with the magnetic gap 20, irrespective of the axial position of the coil. This is accomplished by placing a stationary contact on both sides of the thickness of the gap, with the contacts being in electrical sliding contact with the individual successive wires on the surface of the coil. In this manner, the flow of electrical current is confined to that limited portion of the coil situated in the magnetic gap, regardless of movement of the coil.

As shown, the contacts may comprise a first circular conductive member 30 attached to the center pole 18 of the magnet and having a plurality of conductive resilient fingers 32 to slidably engage the inner cylindrical surface of the coil 24 at a location very near one end of the magnetic gap 28. A second conductive member 34 may be supported from the outer magnet pole 16 and may have resilient fingers 36 in slidable engagement with the outer surface of the coil at or near the other end of the magnetic gap 28. The members 30 and 34 are electrically isolated from each other and are connected to respective leads 31 and 32 from a source of signal current, such as an amplifier.

It will be appreciated that the contacts may engage either the inner or outer surface of the coil to define a limited conductive path therewith. Other types of contacts to accomplish the same general result may be employed.

In operation, it will be understood that the coil can move in either axial direction, as indicated by the arrow, depending on the direction of flow of current through the coil. As current is applied across contacts 30 and 34, the coil moves axially in one direction or the other. In moving to a new position, however, the exposed coil wires traverse across the contacts, such that only a given fraction of the total coil length is activated, such active length substantially corresponding to the thickness or depth 22 of the gap located between the contacts. Thus, irrespective of the axial movement or position of the coil, only that portion within the magnetic gap 20 will carry current. In such fashion, the coil is commutated, in that the current is switched in the coil as the coil moves to keep the active portion in the region of constant magnetic flux.

From the foregoing, it may be seen that the improved moving-coil speaker drive of the present invention offers several distinct advantages over similar linear drives in the prior art. Since only the active portion of the coil is within the magnetic flux, substantial electrical efficiencies are realized. The inactive portions of the coil do not generate heat and can absorb and dissipate heat from the active portion, thereby increasing power handling capacity. The excursion limit can be any desired length, whereas the force on the coil will remain constant per unit of current irrespective of coil position, thereby minimizing sound distortion, particularly at high power, low frequency applications.

In addition, the improved efficiency of the drive enables the use of larger moving masses in the coil and diaphragm, thereby allowing the use of a smaller speaker enclosure for the same intensity of sound production, per watt of input. Finally, the improvement does not substantially increase the cost over a conventional speaker, since many conventional speaker parts may be used.

In viewing the FIGURE of the drawing, it is possible to compare the operating properties of two identical speakers having overhanging coils of the same length, with only one of the drives having the commutating contacts. For example, if the total length of the coil is twice the thickness of the flux gap, the coil resistance in a prior art speaker is double that of the coil described herein. This means that the power efficiency of the present drive would be double that of the prior art drive, and the heat losses would be one-half or less, allowing a potential increase of as much as four times in sound output.

We claim:

1. In a moving-coil loudspeaker wherein the loudspeaker comprises a magnet means having an annular flux gap with a given thickness, a cylindrical coil, means for supporting said coil for movement along the axis thereof, means for supplying said coil with electrical signal current, and a sound diaphragm connected to said coil for activation thereby, the improvement wherein said coil is longer than the thickness of said flux gap, and wherein means are provided to limit the flow of electrical signal current in the coil to a portion thereof disposed in said flux gap irrespective of the axial position of the coil.

2. The improvement of claim 1 wherein the to limit the flow of electrical signal current means comprises a fixed contact on either side of the gap, said portion of said coil being defined between said contacts, said coil being in slidable engagement with said contacts, and the means for supplying electrical signal current being connected across said contacts.

3. A loudspeaker comprising a cylindrical coil, a diaphragm associated with one end of said coil in a driving relationship, means for supporting said coil for axial movement, a pair of spaced fixed contacts in sliding engagement with said coil and defining a limited portion of said coil therebetween, means for supplying said contacts with a source of electrical current, and a fixed magnetic field between said contacts across said coil for reacting with said limited portion and driving said coil and diaphragm.

4. The loudspeaker of claim 3 wherein the driving force on said coil per unit of current across said contacts is constant irrespective of the axial position of said coil.

5. The loudspeaker of claim 3 wherein said contacts comprise a plurality of fingers in contact with the surface of said coil.

6. A moving coil loudspeaker wherein the coil has an improved, linear, peak to peak excursion, said loudspeaker comprising a support, a permanent magnet assembly secured to said support and having opposite pole faces defining an annular flux gap, an annular coil having an axis, means supporting said coil for movement in said flux gap between said pole faces, a sound diaphragm mounted at one end of said coil for actuation thereby, said coil being longer than the thickness of said gap and comprising a winding of wires insulated from each other and an exposed surface of said wires on said coil being electrically conductive, first and second spaced stationary contact means mounted relative to said support and having slidable engagement with the wires on the conductive surface of said movable coil, said contact means being in contact with said coil on either axial side of the gap to define a conductive path through a limited portion of said coil located within said gap.

7. The loudspeaker of claim 6 wherein means are provided for supplying electrical signal current between said contacts to drive said coil axially, the force on said coil per unit of current being substantially constant irrespective of the axial position of said coil.

* * * * *